United States Patent [19]

Allen et al.

[11] 4,357,755

[45] Nov. 9, 1982

[54] COLUMN PAD LAYOUT DEVICE, ANCHOR BOLT LAYOUT DEVICE, AND LAYOUT METHODS

[76] Inventors: William B. Allen; Esther L. Allen, both of 932 W. 49th St. North, Wichita, Kans. 67204

[21] Appl. No.: 161,897

[22] Filed: Jun. 23, 1980

[51] Int. Cl.[3] ..... G01B 5/00

[52] U.S. Cl. ..... 33/180 R; 33/1 H; 33/403; 33/189; 33/478; 33/293; 33/174 G

[58] Field of Search ..... 33/180 R, 403, 174 G, 33/189, 191, 161, 427, 194, DIG. 10, 1 N, 476, 478, 293, 1 H

[56] References Cited

U.S. PATENT DOCUMENTS

| | | | |
|---|---|---|---|
| 942,718 | 12/1909 | Dolby | 33/403 |
| 1,976,264 | 10/1934 | Miner et al. | 33/293 X |
| 2,118,747 | 5/1938 | Vest | 33/428 X |
| 2,493,786 | 1/1950 | Swift | 33/189 |
| 2,867,911 | 1/1959 | Atkinson | 33/194 |
| 2,952,076 | 9/1960 | Gross | 33/161 X |
| 3,219,308 | 11/1965 | Halstead | 33/180 R X |
| 3,805,397 | 4/1974 | Wilamowski | 33/478 |

*Primary Examiner*—William D. Martin, Jr.
*Attorney, Agent, or Firm*—John H. Widdowson

[57] ABSTRACT

A column pad layout fixture having a pair of intersecting cross-arms and a third arm fixed to the intersecting pair of arms. An anchor bolt layout having an elongated rod and a cooperating cross-arm. A method of placing and fixing an anchor bolt plate accurately in a mass of concrete freshly poured into an excavation located at intersecting column center lines to provide a base for a single vertical column of a line of columns. A method of laying out a rectangular or square area upon a plane or flat surface.

8 Claims, 23 Drawing Figures

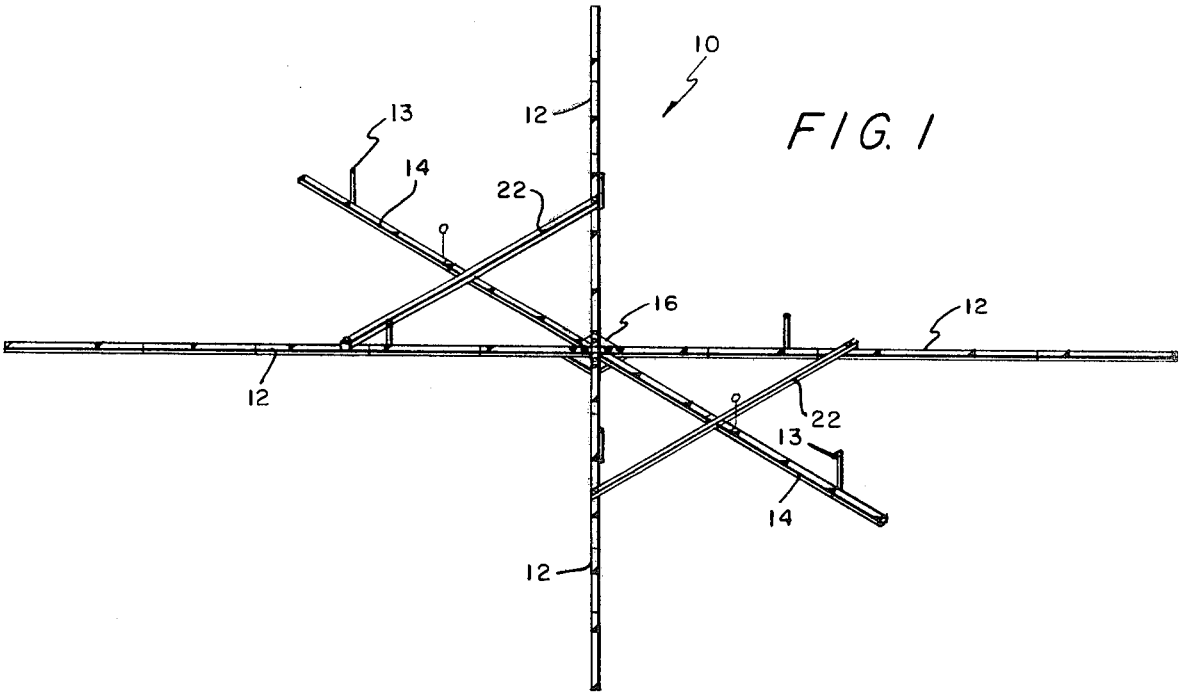
FIG. 1
FIG. 2
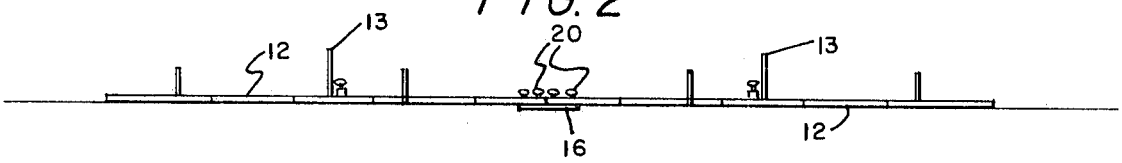
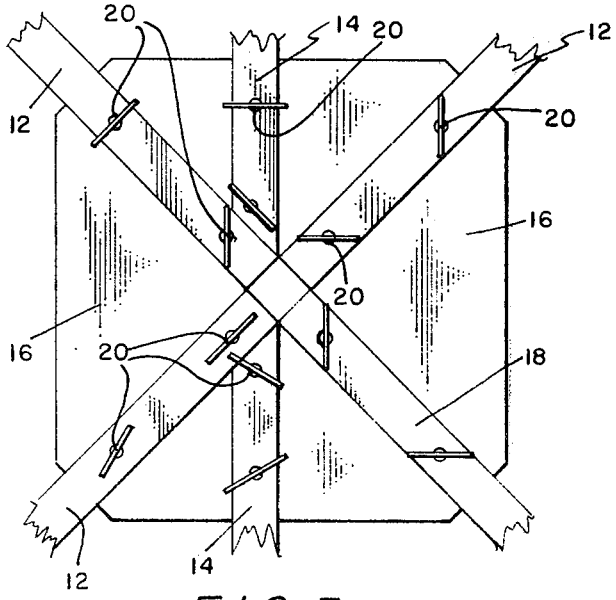
FIG. 3
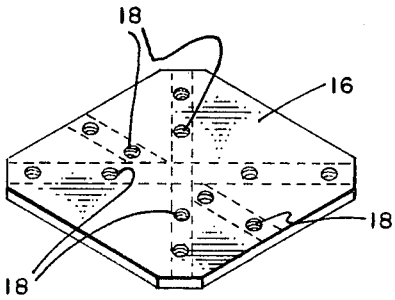
FIG. 4

FIG. 18
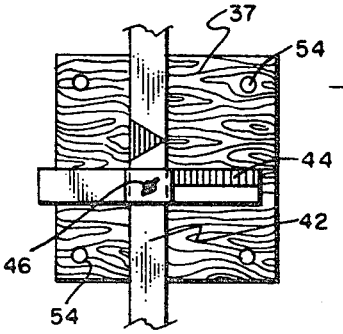
FIG. 20
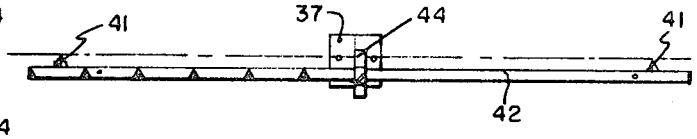
FIG. 21
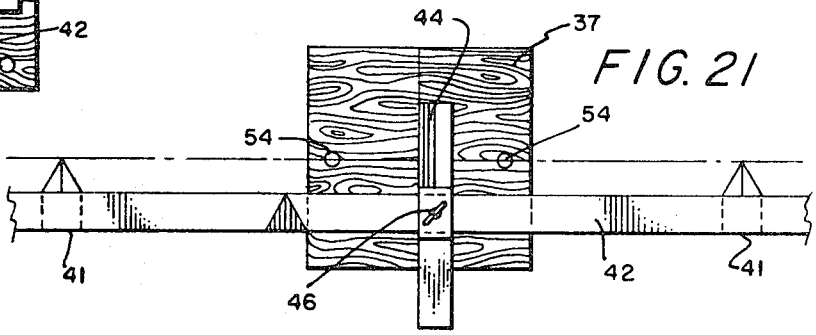
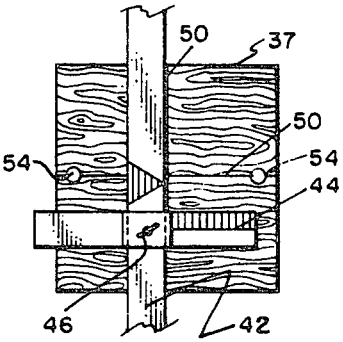
FIG. 19
FIG. 22
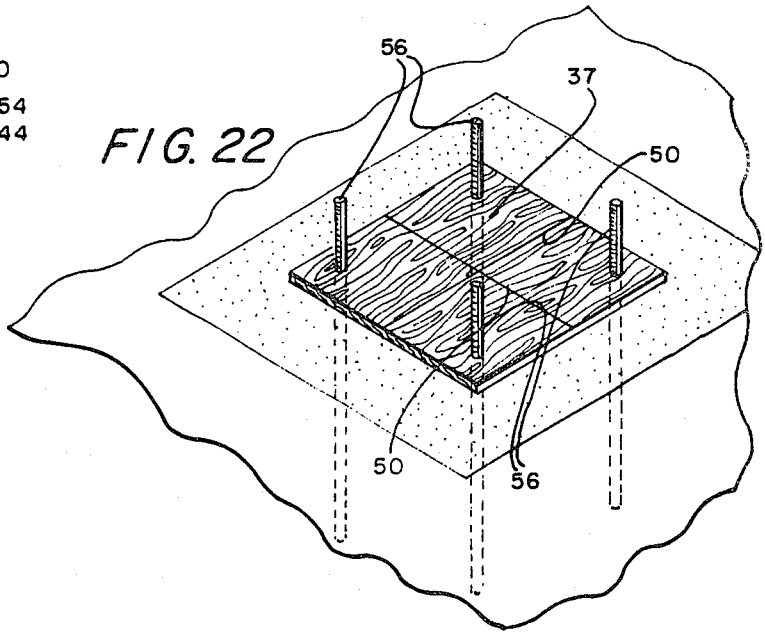
FIG. 23
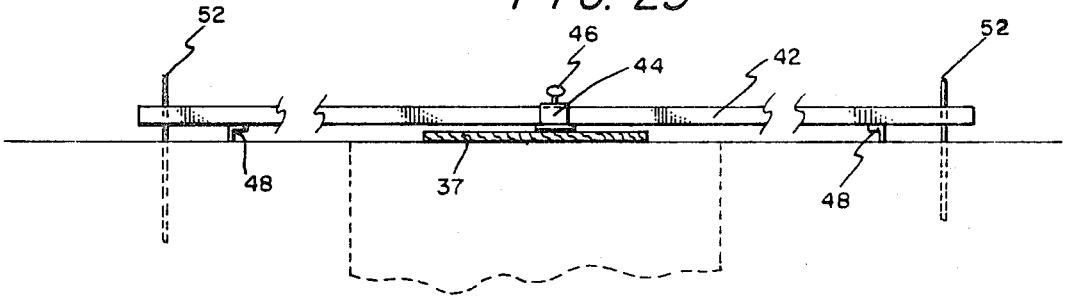

COLUMN PAD LAYOUT DEVICE, ANCHOR BOLT LAYOUT DEVICE, AND LAYOUT METHODS

BACKGROUND OF THE INVENTION

1. Field of the Invention

This invention is related to a column pad layout device and anchor bolt layout device and layout methods.

2. Description of the Prior Art

U.S. Pat. No. 1,554,062 by Zelenski discloses markers or gauges to mark a plurality of holes for planting bulbs or the like in greenhouse operations. U.S. Pat. No. 3,672,064 by Elkins illustrates gauges used to mark and position points for cutouts in panels to accommodate electrical fixtures or other objects. None of the foregoing prior art discloses the column pad layout or the anchor bolt layout device of this invention.

SUMMARY OF THE INVENTION

It is therefore an object of this invention to provide a column pad layout device useful to identify and mark an excavation site of predetermined areal dimensions.

It is another object of this invention to provide an anchor bolt layout device for re-establishing the intersections of a pair of intersecting center lines partially disrupted by an excavation at the intersection.

It is yet another object of this invention to provide a method of placing and fixing an anchor bolt plate accurately in a mass of concrete, and a method of laying out a square area upon a plane or flat surface.

Broadly, the present invention accomplishes the foregoing objects by providing a fixture, useful to identify and mark an excavation site of predetermined areal dimensions comprising a fixed pair of intersecting cross-arms, each formed with a scale denoting units of linear measure. A third arm is fixed to the intersecting pair of arms and subtends an angle of approximately 45° with each arm of the pair of arms. The present invention provides another fixture for re-establishing the intersection of a pair of intersecting center lines partially disrupted by and excavation at the intersection comprising an elongated rod having a straight edge and a cooperating cross-arm having a straight edge. The cross-arm is fixed adjustably relative to the rod so that the straight edges intersect. The straight edges are dimensional to span the excavation whereby the edges can be aligned with the center lines so that the intersection of the straight edges re-establishes the intersection of the center lines. The present invention also provides a method of placing and fixing a template or anchor bolt plate accurately in a mass of concrete poured freshly into an excavation located at intersecting column center lines to provide a base for a single vertical column of a line of columns comprising the steps of:

providing a generally rectangular plate formed with score lines intersecting at the center of the plate;

providing a fixture including a pair of fixed cross-arms defining intersecting straight edges;

placing the fixture upon the concrete so that the straight edges correspond to or align with the intersecting column center lines;

scoring the concrete along the straight edges after aligning;

removing the fixture;

locating the plate upon the concrete so that the plate score lines fall into alignment with the lines scored upon the concrete;

replacing the fixture upon the concrete and upon the plate in its original aligned position;

securing the fixture relative to the intersecting column center lines; and locating the plate precisely by aligning the plate score lines and corresponding straight edges precisely and thereafter removing the fixture.

The present invention lastly provides a method of laying out a rectangular or square area upon a plane or flat surface comprising the steps of:

providing a pair of arms;

fixing the arms relative to one another at their mid-points so that the arms define a cross and subtend angles of 45° one with the other;

marking the arms uniformly with units of linear measure; and placing the fixed arms upon a plane surface and marking the surface at points along each arm defining a predetermined number of units so that each surface mark is equidistant from the mid-points, thus generating the corners of the rectangle or square upon the surface.

BRIEF DESCRIPTION OF THE DRAWINGS

FIG. 1 is a perspective view of the column pad layout device;

FIG. 2 is a side elevation view of the column pad layout device;

FIG. 3 is an exploded, partial top plan view of the central plate having the cross-arms and the third arm secured thereto;

FIG. 4 is a perspective view of the central plate with securing aperture;

FIG. 18 is a partial top plan view of the anchor bolt layout device placed over an anchor plate with apertures in the corners;

FIG. 19 is a partial top plan view of the anchor bolt layout device placed over an anchor plate with two apertures on a plate center line;

FIG. 20 is a top plan view of an anchor bolt layout device over an anchor plate with two apertures along a column center line and two center line indicators attached to the rod;

FIG. 21 is an enlarged, partial top plan view of the anchor plate having the anchor bolt layout device of FIG. 20 imposed thereon;

FIG. 22 is a partial perspective view of an anchor plate being bolted into a concrete slab while aligned with the column center lines which have been scored upon the anchor plate; and FIG. 23 is a partial side elevational view of the anchor bolt layout device placed over an anchor plate which has been situated on a concrete slab.

DETAILED DESCRIPTION OF THE INVENTION

Figure 5:
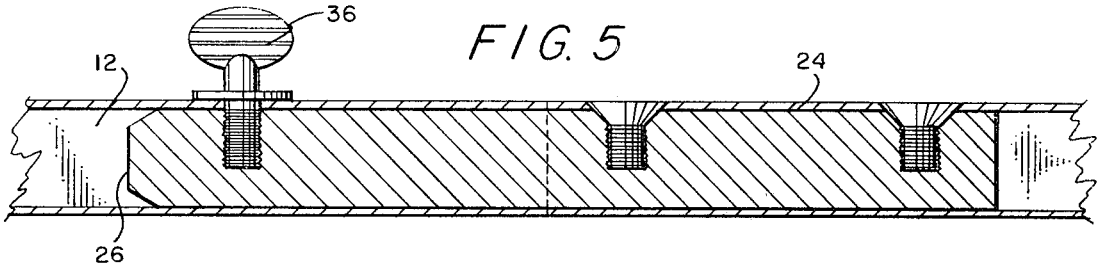
FIG. 5 is an enlarged; partial vertical sectional view of the extension member in telescoping relationship with a cross-arm and a bolt threadably securing the two together.
Figure 6:
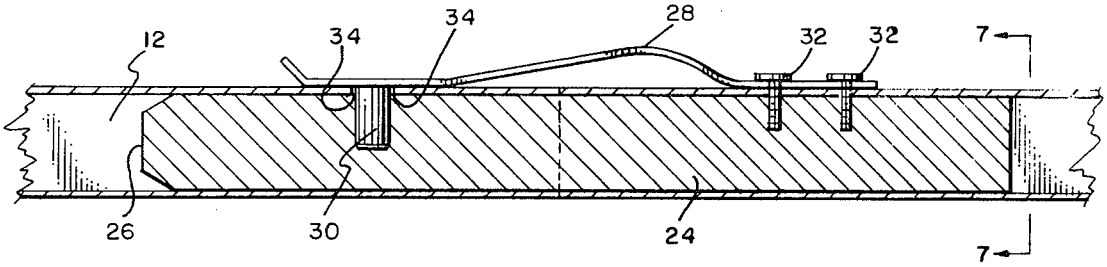
FIG. 6 is an enlarged, partial vertical sectional view of the extension member in telescoping relationship with a cross-arm and secured therewith by a spring clip.
Figure 7:
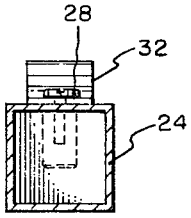
FIG. 7 is a vertical sectional view taken along the plane of line 7—7 in FIG. 6.

Referring in detail now to the drawings, wherein similar parts of the invention are identified by like reference numerals, a column pad layout fixture, generally illustrated as 10, includes a pair of hollow intersecting cross-arms 12, each formed with a scale denoting units of linear measure. A third arm 14 having layout marker 13 intersects the pair of cross-arms 12 and subtends an angle of approximately 45° with each arm 12. A central plate 16 is provided whereupon the cross-arms 12 and the third arm 14 are secured. Plate 16 includes apertures 18 for removably securing the cross-arms 12 and the third arm 14 by thumbscrews 20. The cross-arms 12 are fitted with braces 22 for maintaining a fixed relationship between the pairs of arms 12 which may be fitted with extensions 24 (see FIGS. 5 and 6) formed with a nose 26 adapted to be received in telescoping fashion within the hollow arms 12 to create an assembly. The extensions 24 are fitted with spring clips 28 terminating in a locating pin 30 operative to fix the extension 24 relative to a mating arm 12. Spring clip 28 is removably riveted by rivets 32 to the extension 24. Nose 26 of extension 24 and its mating cross-arm 12 each have apertures 34 operative to receive the removable locating pin 30 when in assembly. Spring clip 28 can be removed and the extension 24 can be threadably secured to arm 12 by bolt 36 (see FIG. 5).

Figure 9:
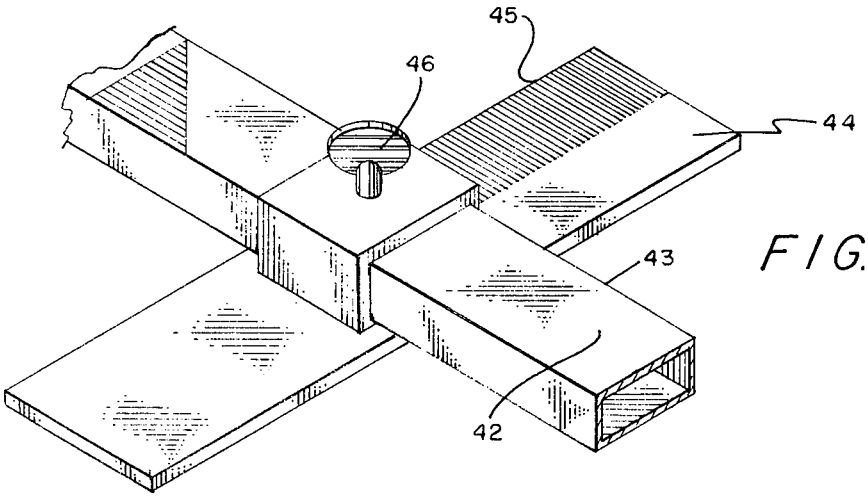
FIG. 9 is an exploded, partial perspective view of the anchor cross-arm secured to the anchor rod.
Figure 15:
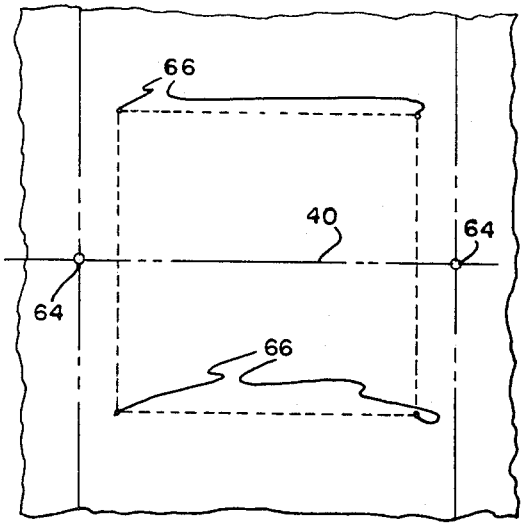
FIG. 15 is a top plan view of a surface illustrating in dotted lines an excavation area.
Figure 16:
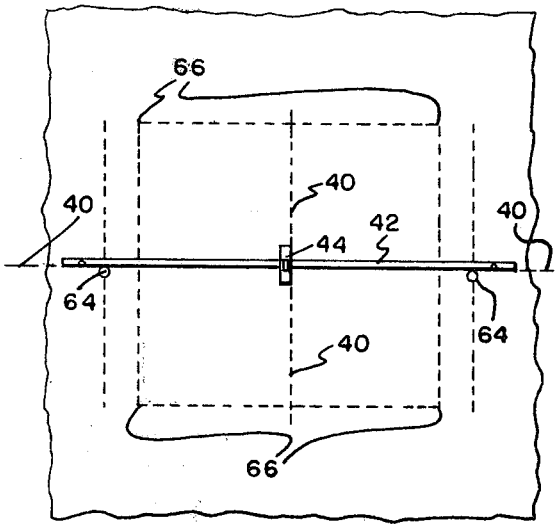
FIG. 16 is a top plan view of the anchor bolt layout device situated over the excavation site.
Figure 17:
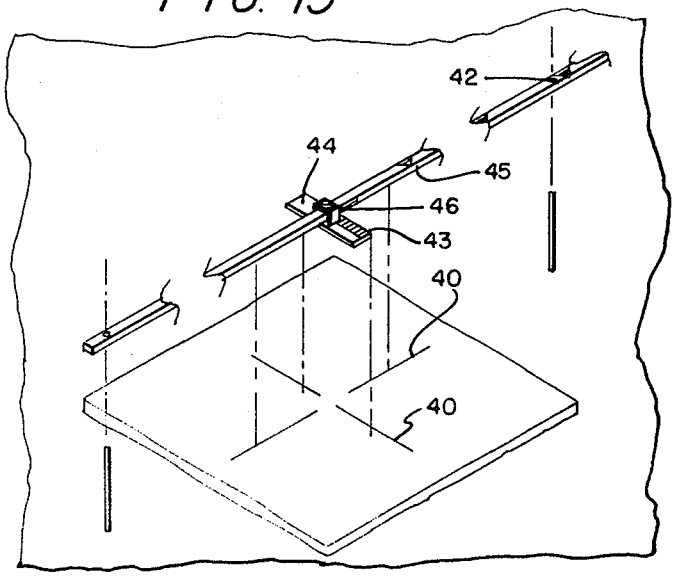
FIG. 17 is a partial perspective view of the anchor bolt layout device to be used to score center lines on a concrete slab after the excavation and the pouring of the concrete.

Another embodiment of the invention is an anchor bolt 37 layout fixture, generally illustrated as 38, for re-establishing the intersection of a pair of intersecting center lines 40 (see FIGS. 15, 16 and 17) partially disrupted by an excavation at the intersection, comprising an elongated rod 42 having a straight edge 43 and a cooperating cross-arm 44 including a straight edge 45. The cross-arm 44 is adjustably fixed by bolt 46 to the rod 42 so that the straight edges 43–45 intersect (see FIG. 9). The straight edge 43 of rod 42 and straight edge 45 of cross-arm 44 are dimensioned to span the excavation (see FIG. 16) whereby the edges 43–45 can be aligned with the center lines 40 so that the intersection of the straight edges 43 and 45 re-establishes the intersection of the center lines 40. The extremities of the rod 42 are formed with legs 48 (see FIG. 23) operable to support the rod 42 above grade. Rod 42 may also have attached thereto offsetting center line indicator 41 (see FIG. 20).

With continuing reference to the drawings for the method and operation of the anchor plate invention, anchor bolt plate 37 may be accurately placed and fixed in a mass of concrete poured freshly into an excavation (represented as dotted lines in FIG. 22) which is located at intersecting column center lines 40 to provide a base for a single vertical column of a line of columns. Score lines 50 are placed on the plate 37 such as to intersect at the center of the plate 37. The fixture 38 is placed upon the concrete (see FIG. 17) so that the edges 43–45 correspond to or align with the intersecting column center lines 40. The concrete is preferably scored along the straight edges 43–45 after the alignment with column center lines 40 and subsequently the fixture 38 is removed from the concrete. The plate 37 is thereafter located on the concrete so that the score lines 50 generally fall into alignment with the lines scored upon the concrete. The fixture 38 is then replaced upon the concrete and upon the scored plate 37 in its original aligned position. The fixture 38 is secured relative to the intersecting column center lines 40 by pegs 52 (see FIG. 22), and the plate 37 is subsequently precisely located by aligning the plate score lines 50 and the corresponding straight edges 43–45 (see FIGS. 18 and 19); and thereafter, the fixture 38 is removed. Plate 37 includes apertures 54 and receiving bolts 56 for fixing the plate 37 rigidly in the concrete. The bolts 56 may be provided with cooperating nuts which are operable to adjust the plate 37 relative to the surface of the concrete.

Figure 8:
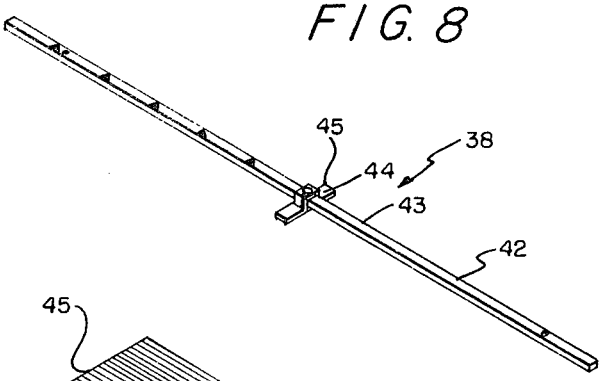
FIG. 8 is a perspective view of the anchor bolt layout device.
Figure 10:
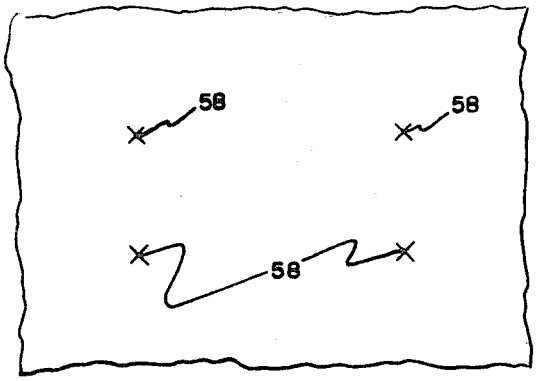
FIG. 10 is a top plan view of a surface with "Xs" representing the corners of a building to be constructed.
Figure 11:
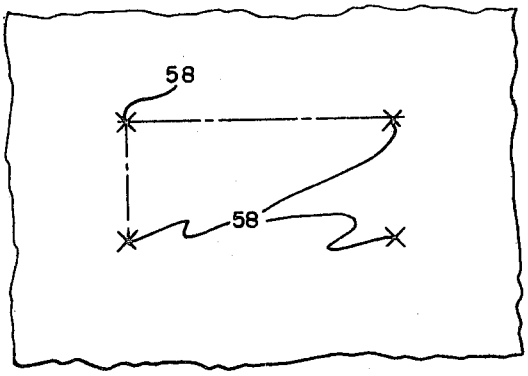
FIG. 11 is a top plan view of the surface with "Xs" representing the corners of a building and having two base lines labeled.
Figure 12:
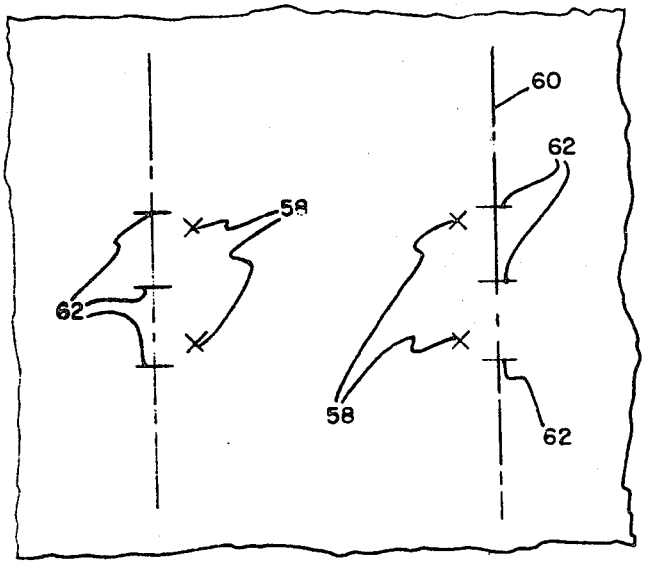
FIG. 12 is a top plan view illustrating the offset lines having indicia thereon representing the location and spacing of the column center lines.
Figure 13:
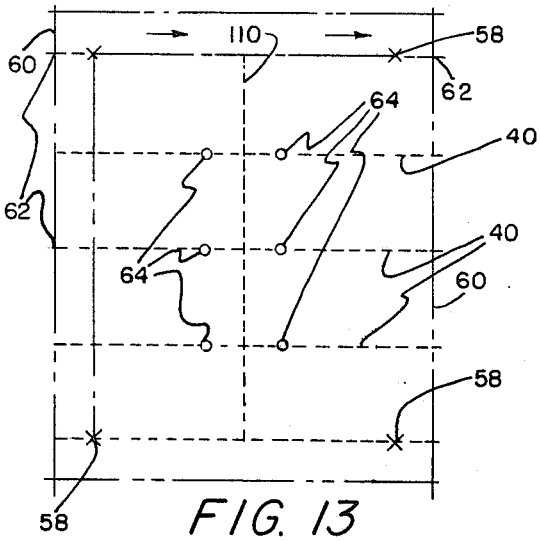
FIG. 13 is a top plan view illustrating the offset lines and offset points on the column center lines.
Figure 14:
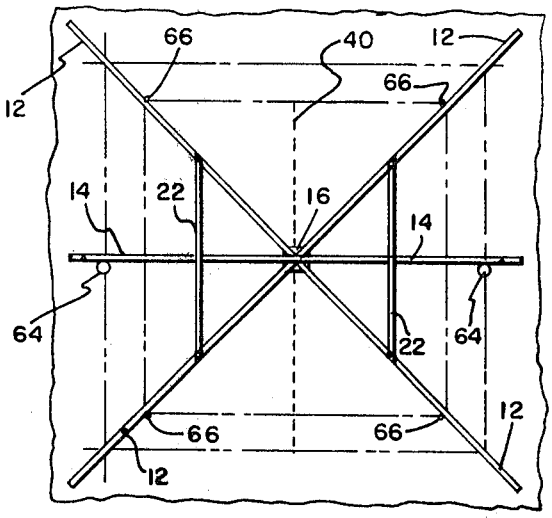
FIG. 14 is a top plan view of the column pad layout device having its third arm situated along two offset points in order to mark off the corners of an area to be excavated.

Another embodiment of the invention is the operation of the fixture 10 which lays out a rectangular square area upon a plane or flat surface. The "Xs" 58 in FIGS. 10 and 11 represent the corners of the building whereupon columns are to be constructed. Line 60 in FIG. 12 represents offset lines and the indicia 62 thereon is the location and spacing of the column center lines. From the points 62 of the column center lines now established on the building offset lines 60, a transit level (not shown in the drawings) sets two offset points 64 (see FIG. 13) per column pad on the column center line (one direction only: in direction of the arrows in FIG. 13). Arm 14 of fixture 10 is placed alongside a column center line (see FIG. 14) on points 64. The surface is marked at points 66 which is a predetermined point along each arm 12 so that the points 66 are equidistant from the mid-points, thus generating the corners of the square upon the surface. This square area could be the excavation area for removing dirt and subsequently pouring concrete. After the concrete has been poured, the fixture 38 of FIG. 8 (as has been previosuly mentioned) may be utilized to place the plate 37 within the concrete.

While the present invention has been described herein with reference to particular embodiments thereof, a latitude of modifications, various changes and substitutions are intended in the foregoing disclosure, and in some instances some feature of the invention will be employed without a corresponding use of other features without departing from the scope of the invention as set forth.

We claim:

1. A fixture useful to identify and mark an excavation site of predetermined areal dimensions comprising a fixed pair of intersecting cross-arms generally representing an X-shape, each formed with a scale denoting units of linear measure; a third arm fixed to said intersecting pair of arms and subtending an angle of approximately 45° with each arm of said pair of arms and an opposed sides of said X-shape representation; and a central plate whereupon said cross-arms and said third arm are secured, said cross-arms representing an X-shape are hollow and are fitted with braces for maintaining their fixed relationship, said braces are fitted to said opposed sides wherein said third arm subtends an angle of approximately 45°, said cross-arms are fitted with extensions means which are formed with a nose means adapted to be received in telescoping fashion within said hollow arms to create an assembly, said extensions are fitted with spring clips terminating in and integrally bound to locating pin operative to fix the extension relative a mating arm, said nose means and its mating cross-arm each formed with apertures operative to receive said locating pin when in assembly.

2. The fixture of claim 1 in which the spring clip is riveted to said extension.

3. The fixture of claim 2 in which said arms are secured removably to said plate by means of thumbscrews.

4. A method of placing and fixing a template or anchor bolt plate accurately in a mass of concrete poured freshly into an excavation located at intersecting column center lines to provide a base for a single vertical column of a line of columns comprising the steps of:

(a) providing a generally rectangular plate formed with score lines intersecting at the center of the plate;

(b) providing a fixture including an elongated rod having a straight edge, a cooperating cross-arm having a straight edge and being of substantially less length than said rod and being fixed adjustably relative to said rod so that said straight edges intersect;

(c) placing said fixture upon said concrete so that the straight edges correspond to or align with the intersecting column center lines;

(d) scoring the concrete along said straight edges after said alignment in step (c);

(e) removing said fixture;

(f) locating the plate upon said concrete so that the plate score lines fall into alignment with the lines scored upon the concrete;

(g) replacing the fixture upon the concrete and upon the plate in its original aligned position;

(h) securing the fixture relative to said intersecting column center lines; and (i) locating the plate precisely by aligning the plate score lines and corresponding straight edges precisely and thereafter removing said fixture.

5. The method of claim 4 additionally including forming apertures in the plate; and inserting bolts in said apertures for fixing the plate rigidly to the concrete.

6. The method of claim 5 additionally comprising the bolts with cooperating nuts operable to adjust the plate relative to the surface of the concrete.

7. A method of laying out a rectangular or square area upon a plane or flat surface comprising the steps of:

(a) providing a pair of arms;

(b) fixing the arms relative to one another at their mid-points so that the arms define a cross of X-shape representation;

(c) providing a third arm fixed to said intersection pair of arms and subtending an angle of approximately 45° with each arm of said pair of arms and an opposed sides of said X-shape representation;

(d) marking the arms uniformly with units of linear measure; and (e) placing the fixed arms upon a plane surface and marking the surface at points along each arm defining a predetermined number of units so that each surface mark is equidistant from said mid-points, thus generating the corners of said rectangle or square upon said surface.

8. The method of claim 4 additionally comprising providing a plurality of legs and forming same with the extensions of said rod for operably supporting the rod above grade.

* * * * *